United States Patent [19]

Kobayashi et al.

[11] Patent Number: 4,480,602

[45] Date of Patent: Nov. 6, 1984

[54] LUBRICATING SYSTEM FOR TWO-CIRCLE INTERNAL COMBUSTION ENGINE

[75] Inventors: Yoshiaki Kobayashi, Hamamatsu; Atsushi Mori, Iwata, both of Japan

[73] Assignee: Sanshin Kogyo Kabushiki Kaisha, Japan

[21] Appl. No.: 506,533

[22] Filed: Jun. 21, 1983

[30] Foreign Application Priority Data

Jul. 30, 1982 [JP] Japan ..... 57-132072

[51] Int. Cl.[3] ..... F02B 33/04; F01M 1/00

[52] U.S. Cl. ..... 123/73 AD; 123/196 R; 123/196 W

[58] Field of Search ..... 123/73 AD, 196 R, 196 W

[56] References Cited

U.S. PATENT DOCUMENTS 4,369,743 1/1983 Holt et al. ..... 123/73 AD
4,383,504 5/1983 Walsworth ..... 123/73 AD

FOREIGN PATENT DOCUMENTS 2437491 5/1980 France ..... 123/73 AD

*Primary Examiner*—Ethel R. Cross
*Attorney, Agent, or Firm*—Ernest A. Beutler

[57] ABSTRACT

A lubricating system for two-cycle crankcase compression internal combustion engines that provides adequate lubrication under all running conditions. The speed of the engine is sensed and provides a control signal to a mapping device which supplies the amount of lubricant between the maximum and minimum anticipated loads at that speed.

7 Claims, 3 Drawing Figures

LUBRICATING SYSTEM FOR TWO-CIRCLE INTERNAL COMBUSTION ENGINE

BACKGROUND OF THE INVENTION

This invention relates to a lubricating system for two-cycle internal combustion engines and more particularly to an improved and simplified arrangement for insuring adequate engine lubrication under all running conditions.

As is well known, two-cycle engines pose certain problems in connection with the design of their lubrication systems. Although it has been proposed to mix lubricating oil with the fuel to lubricate the running components, the ratio of fuel and oil necessary to provide adequate lubrication under different running conditions is not the same. That is, when running under a light load and relatively small throttle opening, the engine can operate on a lesser amount of lubricant than when it is running at a higher load and/or higher throttle opening. The lubricant requirements are, however, not directly related to either engine speed or engine load per se. Thus, engines embodying a fixed ratio of lubricant to fuel may be underlubricated under some conditions and overlubricated under other conditions.

It has been proposed to provide a lubricating system in which a variable output lubricant pump delivers lubricant to the fuel system for mixing with the fuel before delivery to the engine. In accordance with an arrangement proposed by the inventors hereof, as disclosed in Japanese Patent Application No. 56-192062, filed Nov. 30. 1981, the variable output lubricant pump is controlled in accordance with changes in engine speed and throttle opening. Thus, if there is a change in either engine speed or throttle opening, an adequate and proper amount of lubricant will be delivered to the fuel system for induction to the engine. Although such an arrangement obviously has advantages, it is also complicated and adds significantly to the cost of the motor since complicated and expensive throttle and speed controls are required in conjunction with that system.

It is, therefore, a principal object of this invention to provide an improved and simplified arrangement for lubricating two-cycle internal combustion engines.

It is a further object of this invention to provide an improved and simplified lubricating system for two-cycle engines that will provide an optimum degree of lubrication under all conditions.

It is a further object of this invention to provide an improved and simplified variable output lubricant system for two-cycle engines.

SUMMARY OF THE INVENTION

A first feature of the invention is adapted to be embodied in a lubricating system for two-cycle internal combustion engines operating over a range of speed and load conditions wherein the lubricant demands of the engine at a certain one of the conditions range from a minimum amount at the minimum anticipated of the other of the conditions and a maximum amount at the maximum of the anticipated other condition. The system includes a variable output lubricant delivery means for delivering lubricant to the engine. In accordance with this feature of the invention, means are provided for sensing the one condition and control means control the amount of output of the variable output lubricant delivery means. The control means provides a predetermined amount of lubricant between the minimum and the maximum in response to the sensed one condition.

Another feature of the invention is adapted to be embodied in a method for delivering lubricant to a two-cycle internal combustion engine operating over a range of speed and load conditions wherein the lubricant demands of the engine at a certain one of the conditions range from a minimum amount at the minimum anticipated of the other conditions and a maximum amount at the maximum anticipated other condition. In accordance with the invention, means are provided for sensing one of the conditions and for supplying a quantity of lubricant to the engine at the one sensed condition that is a predetermined point between the minimum and maximum.

DETAILED DESCRIPTION OF THE PREFERRED EMBODIMENT

Figure 1:
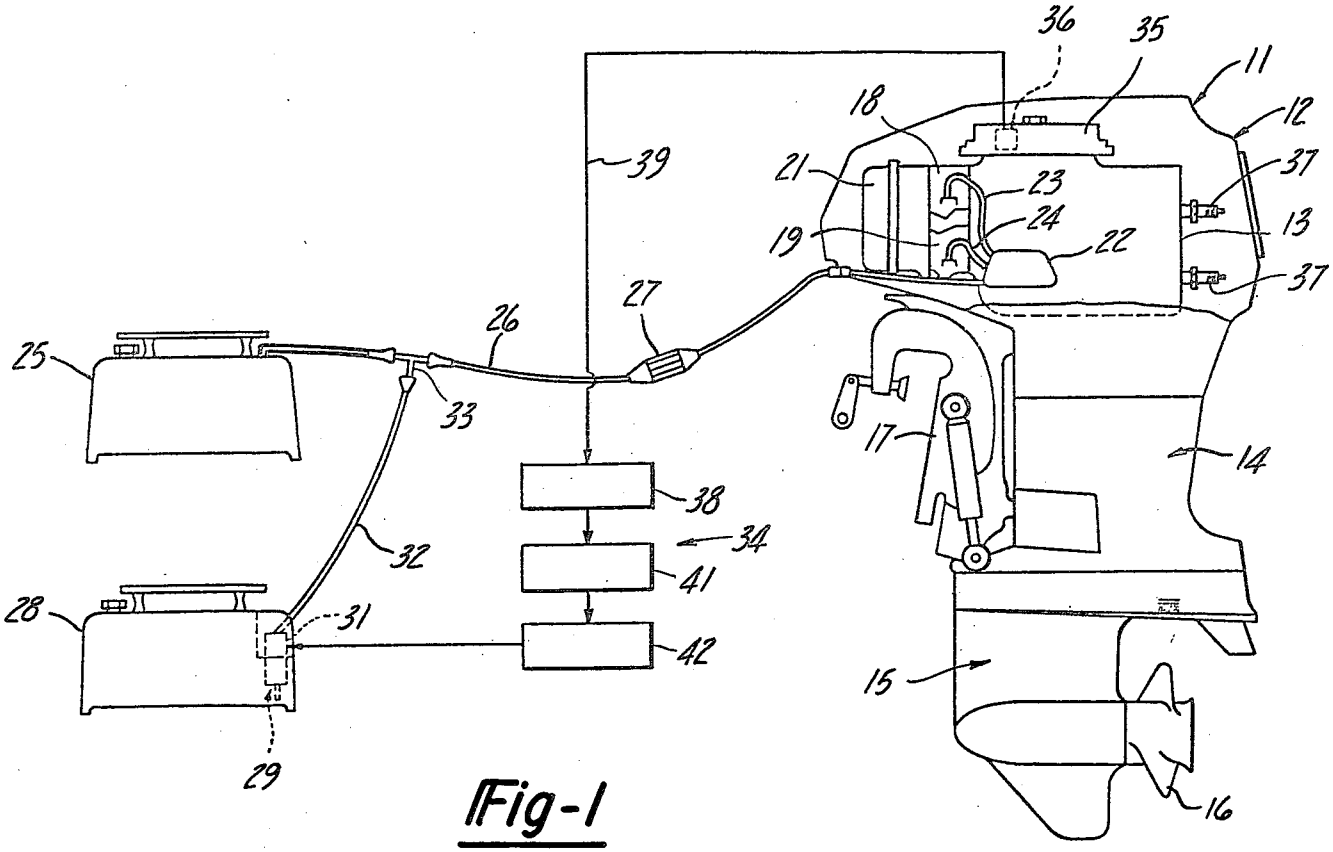
FIG. 1 is a side elevational view of an outboard motor having a lubrication system constructed in accordance with an embodiment of this invention, with certain components shown schematically.

Referring first to FIG. 1, an outboard motor having a fuel and lubricant system embodying this invention is identified generally by the reference numeral 11. The outboard motor 11 includes a power head 12 in which an internal combustion engine 13 is positioned. The engine 13 is of the two-cycle type having crankcase compression and, in the illustrated embodiment, is depicted as being of the two cylinder, in-line type. Depending from the power head 12 is a drive shaft housing 14 in which a drive shaft (not shown) is supported for rotation and which is driven by the engine 13. A lower unit 15 is positioned beneath the drive shaft housing 14 and rotatably supports a propeller 16 that is driven from the drive shaft in a known manner. A clamping bracket 17 is also provided so as to permit detachable connection of the motor 11 to the transom of an associated watercraft (not shown).

The engine 13 is provided with an induction system comprising a pair of carburetors 18 and 19, there being one such carburetor for each cylinder of the engine 13. The carburetors 18 and 19 draw an air charge through an induction device 21 and prepare a fuel/air mixture for discharge into the crankcase of the engine 13 for transfer to the respective cylinders in a known manner.

An engine driven fuel pump 22 is provided that discharges to each of the carburetors 18, 19, through a respective fuel line 23, 24. The fuel pump 22 may be of any known type, for example, the diaphragm type that is driven by variation in the pressure in the crankcase chambers of the engine 13. The fuel system further includes a remotely positioned fuel tank 25 that is positioned in the hull of the associated watercraft and which has a delivery conduit 26 that extends to the engine driven fuel pump 22. A manually operated fuel pump 27 is positioned in the conduit 26 in a location to be described.

The motor 11 is provided with a separate lubricating system including a lubricant storage tank 28 that may conveniently be positioned within the hull of the associated watercraft. An intermittently operated, electric pump 29 driven by an electric motor 31 is position within the lubricant storage tank 28. The pump 29 delivers lubricant from the tank 28 to a conduit 32. The conduit 32 supplies lubricant to a T-connection 33 that is positioned in the fuel conduit 26. The T-connection 33 may be either downstream from the manually operated pump 27 or upstream of it. That is, the manually operated pump 27 may be positioned either between the T-connection 33 and the engine driven fuel pump 22 as in the illustrated embodiment, or between the fuel tank 25 and the T-connection 33.

By delivering lubricant to the fuel conduit 26, mixing of the fuel and lubricant is insured before delivery to the engine driven fuel pump 22. Although this location has been illustrated for introducing the lubricant to the fuel line, it should be readily apparent that other mixing locations may be employed without departing from the invention. Alternatively, it may also be possible to use this invention in conjunction with arrangements wherein lubricant is delivered directly to the engine rather than being mixed with the fuel or in systems wherein lubricant is both mixed with the fuel and delivered directly to the engine.

The amount of lubricant mixed with the fuel is controlled by a control device, indicated generally by the reference numeral 34. The control device 34 is illustrated schematically and controls the operation of the pump 29 and, accordingly, the amount of lubricant delivered to the conduit 26 in response to running conditions, as will be now described.

The engine 13 includes a magneto flywheel 35 that is affixed for rotation with the crankshaft in a known manner. The flywheel 35 includes a pulser coil 36 that provides a triggering pulse for firing spark plugs 37 associated with the cylinders of the engine 13. Inasmuch as the engine 13 is of the two cylinder, two-cycle type, the pulser coil 36 provides an impulse twice for each revolution of the magneto flywheel 35. In addition to providing a signal for firing the spark plugs 37, the pulser coil 36 delivers a signal to a tachometer 38 by means of a suitable connection, indicated schematically at 39. The tachometer 38 receives the pulses from the pulser coil 36 and generates a voltage output that is proportional to the speed of rotation of the flywheel magneto 35.

The output of the tachometer 38 is delivered to a lubricant flow rate control or setting device 41. The setting device 41 is programmed so as to provide a predetermined amount of lubricant flow for a given speed of the engine as sensed by the tachometer 38, in a manner to be described.

The flow rate setter 41 has an output signal that comprises a voltage and which is delivered to a pulse oscillator 42. The pulse oscillator 42 generates a pulse for a predetermined period of time so as to energize the driving motor 31 of the pump 29 for the appropriate period of time so as to provide the desired amount of lubricant flow from the tank 28 through the conduit 32 for mixing with the fuel in the conduit 26. The mapping or setting of the control 34 and specifically the setter 41 will be described by particular reference to FIGS. 2 and 3.

Figure 2:
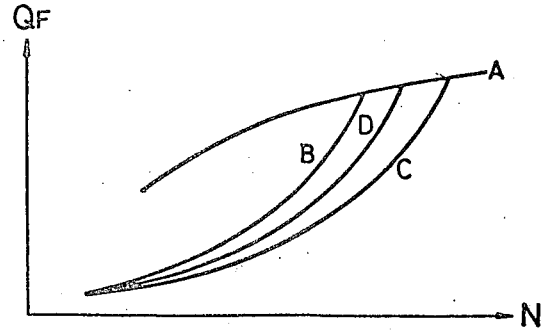
FIG. 2 is a graph showing the relationship of fuel consumption to engine speed.

Considering first FIG. 2, this is a curve showing the relationship of the engine speed to fuel consumption at various loading conditons. Engine speed is indicated on the abscissa by the line N and fuel consumption is indicated on the ordinate as $Q_F$. The actual fuel consumption at a given speed will be dependent upon the load which is determined by the throttle setting. The curve A shows the fuel consumption curve at full throttle. The curve B represents the fuel consumption curve in relation to engine speed during maximum loading conditions. The curve C is the fuel consumption curve at varying engine speeds under minimum anticipated load conditions.

Figure 3:
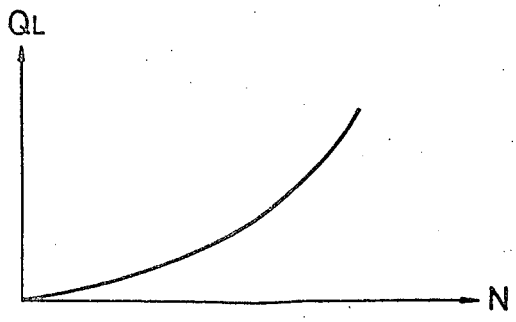
FIG. 3 is a graph showing the lubricant delivery in accordance with the invention in relation to engine speed.

From FIG. 2, it should be readily apparent that the actual fuel requirements of the engine for any given speed and running condition lie within the area bounded by the curves A, B and C. In accordance with the invention, a curve between the curves B and C, identified as the curve D, is chosen to determine the necessary lubricant requirements for the engine. The curve D may have any desired shape but generally lies between the curves B and C although it need not lie midway between these two curves. Once the curve D has been selected, the actual lubricating requirements for the engine at the load represented by the curve D are then determined in accordance with the curve shown in FIG. 3. In FIG. 3, the amount of lubricant $Q_L$ is shown on the ordinate and engine speed N is represented on the abscissa. The curve shown in FIG. 3 is a map of the actual lubricant requirements at the load represented by the curve D. This curve is then fed or programmed into the setting device 42 so that when the tachometer 38 senses a certain speed, the setting device 42 will select the appropriate pulse width for operating the pump 29 to provide the desired amount of lubricant required in accordance with the curve shown in FIG. 3.

Although using an approximation of load for a given throttle setting does not provide the exact amount of lubricant required for all running conditions, it has been found that the variations are small enough so as to permit acceptable running of the engine and adequate lubrication through the use of this method and apparatus.

When the motor 11 is running and fuel is delivered to the carburetors 18 and 19 by the fuel pumps 27 and 22, the tachometer 38 will sense the engine speed and provide a voltage signal indicative of engine speed to the flow rate setter 31. The setter 31 then selects the appropriate amount of lubricant in accordance with the curve shown in FIG. 3 in the aforedescribed manner and sends a signal to the pulser device 42 so as to operate the fuel pump 29 for the period of time necessary to supply the preset amount of lubricant. This lubricant will be delivered to the T-connection 33 for mixing with the fuel flowing through the line 26 so as to insure adequate lubrication.

It should be readily apparent that the described construction and method permits a relatively simple and yet highly effective device for adding lubricant to a two-cycle engine so as to provide adequate lubrication throughout its speed and load ranges. Although an embodiment of the invention has been illustrated and described, various changes and modifications may be made without departing from the spirit and scope of the invention, as defined by the appended claims.

We claim:

1. In a lubricating system for a two-cycle internal combustion engine operating over a range of speed and load conditions wherein the lubricant demands of the engine at a certain one of such conditions range from a maximum amount at the maximum anticipated of the other conditions and a minimum amount at the minimum anticipated other condition, said system comprising variable output lubricant delivery means for delivering lubricant to the engine, the improvement comprising means for sensing the one condition and control means for controlling the amount of output of said variable output lubricant delivery means, said control means providing a predetermined amount of lubricant between the minimum and maximum amounts in response to the sensed one condition.

2. In a lubricating system as set forth in claim 1 wherein the sensed condition comprises engine speed.

3. In a lubricating system as set forth in claim 2 wherein the sensing means comprises a tachometer.

4. In a lubricating system as set forth in claim 3 wherein the tachometer provides a control signal to a device that is mapped in response to the other condition for providing a control for the variable output lubricant delivery means.

5. In a lubricating system as set forth in claim 4 wherein the lubricant delivery means comprises an intermittently operated electric pump.

6. A method of lubricating a two-cycle internal combustion engine operating over a range of speed and load conditions wherein the lubricant demands of the engine at a certain one of the conditions range from a minimum amount at the minimum anticipated of the other conditions and a maximum amount at the maximum anticipated other condition comprising the steps of sensing one of the conditions and providing an amount of lubricant between the minimum and maximum anticipated other condition.

7. A method as set forth in claim 6 wherein the speed of the engine is the sensed condition.

* * * * *